United States Patent [19]

Burney et al.

[11] 4,182,595

[45] Jan. 8, 1980

[54] DISCHARGE ASSEMBLY FOR AN AXIAL FLOW COMPRESSOR

[75] Inventors: Ivan T. Burney, Plum Boro, Pa.; Tsoy K. Moy, Santa Clara, both of Calif.

[73] Assignee: Westinghouse Electric Corp., Pittsburgh, Pa.

[21] Appl. No.: 873,342

[22] Filed: Jan. 30, 1978

[51] Int. Cl.[2] ..... F04D 29/54

[52] U.S. Cl. ..... 415/204; 415/206; 415/207; 415/210

[58] Field of Search ..... 415/199.4, 199.6, 204, 415/206, 207, 210, 219 B, 219 C

[56] References Cited

U.S. PATENT DOCUMENTS

| | | | |
|---|---|---|---|
| 1,578,843 | 3/1926 | Moody | 415/207 X |
| 2,724,545 | 11/1955 | Oechslin | 415/207 X |

FOREIGN PATENT DOCUMENTS

| | | | |
|---|---|---|---|
| 182804 | 4/1907 | Fed. Rep. of Germany | 415/206 |
| 837192 | 4/1952 | Fed. Rep. of Germany | 415/206 |
| 931344 | 10/1947 | France | 415/199.6 |
| 466345 | 5/1975 | U.S.S.R. | 415/207 |

*Primary Examiner*—Carlton R. Croyle
*Assistant Examiner*—Thomas I. Ross
*Attorney, Agent, or Firm*—F. J. Baehr, Jr.

[57] ABSTRACT

A discharge assembly for an axial flow compressor which places a diffuser which extends radially outwardly and axially outwardly adjacent the last row of rotatable blades to efficiently convert the swirl energy of the fluid into pressure energy without utilizing one or more arrays of stationary blades to straighten the flow before it enters the diffuser.

3 Claims, 3 Drawing Figures

DISCHARGE ASSEMBLY FOR AN AXIAL FLOW COMPRESSOR

BACKGROUND OF THE INVENTION

This invention relates to axial flow compressors and more particularly to a discharge assembly including a diffuser for converting the swirling energy of the effluent fluid to pressure energy.

Axial flow compressors normally have one or more circular arrays of stationary blades disposed after the last circular array of rotating blades to eliminate the swirl in the effluent fluid as it flows from the last circular array of rotating blades. The diffuser in such an arrangement normally has an inner cylindrical wall portion which extends axially downstream of the stationary straightening blades and a frusto-conical outer wall portion which allows the effluent fluid to expand as it moves axially toward the discharge nozzle.

SUMMARY OF THE INVENTION

A discharge assembly for an axial flow compressor having a longitudinal axial and multiple circular array of stationary and rotatable blades disposed along said axes to compress a compressible fluid, when made in accordance with this invention, comprises a diffuser disposed directly downstream of the last circular array of rotatable blades. The diffuser has an inner and outer wall portion, which extends axially outwardly and radially outwardly from the last circular array of rotatable blades. The assembly further comprises a scroll in fluid communication with the diffuser, and a discharge nozzle disposed downstream of the scroll. The diffuser and scroll cooperate to efficiently convert the swirling energy in the effluent fluid to pressure energy as the effluent fluid enters the discharge nozzle.

BRIEF DESCRIPTION OF THE DRAWINGS

The objects and advantages of this invention will become more apparent from reading the following detail description in connection with the accompanying drawings, in which.

DESCRIPTION OF THE PREFERRED EMBODIMENT

Figure 1:
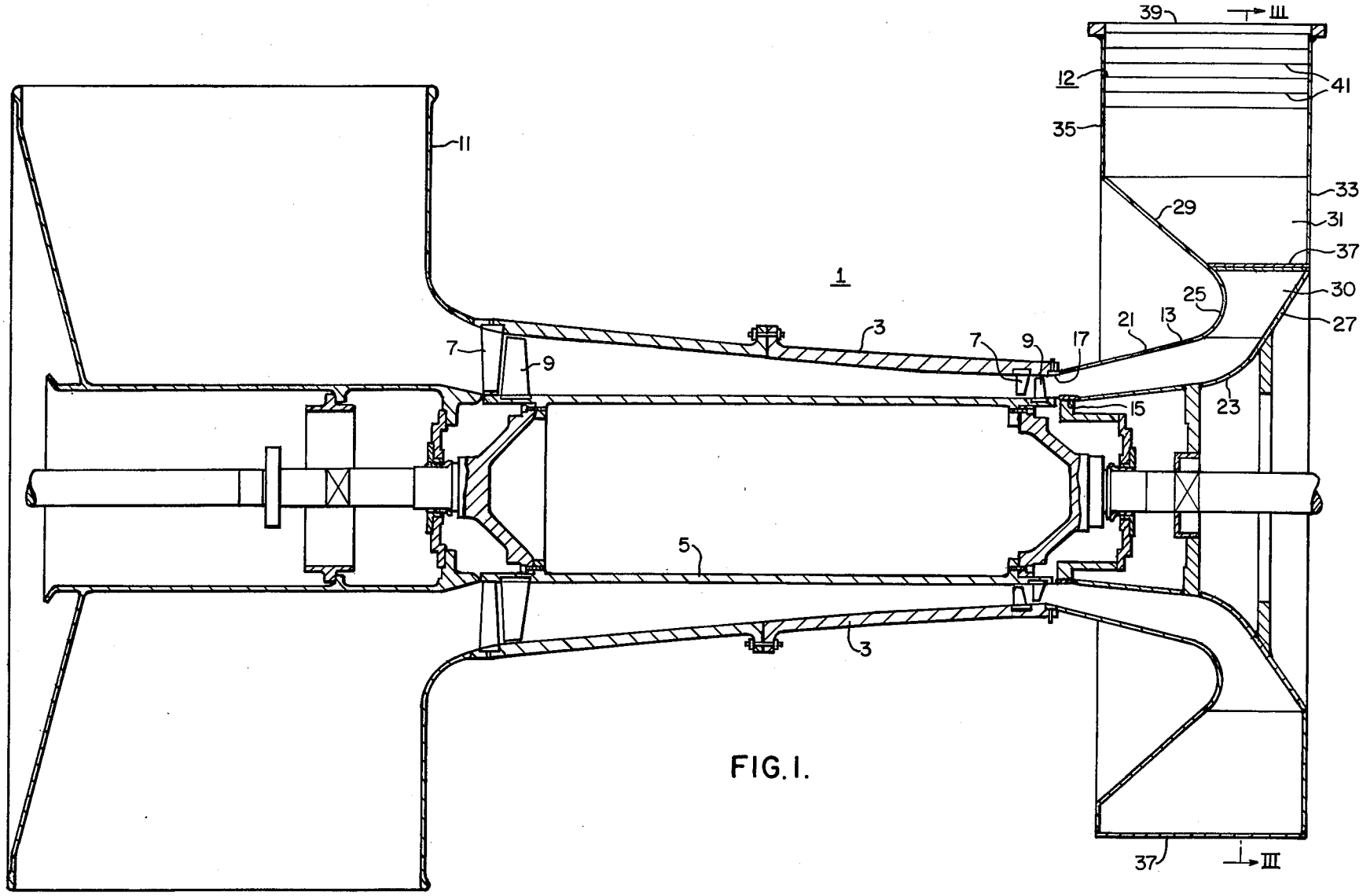
FIG. 1 is a sectional view of a compressor made in accordance with this invention.
Figure 2:
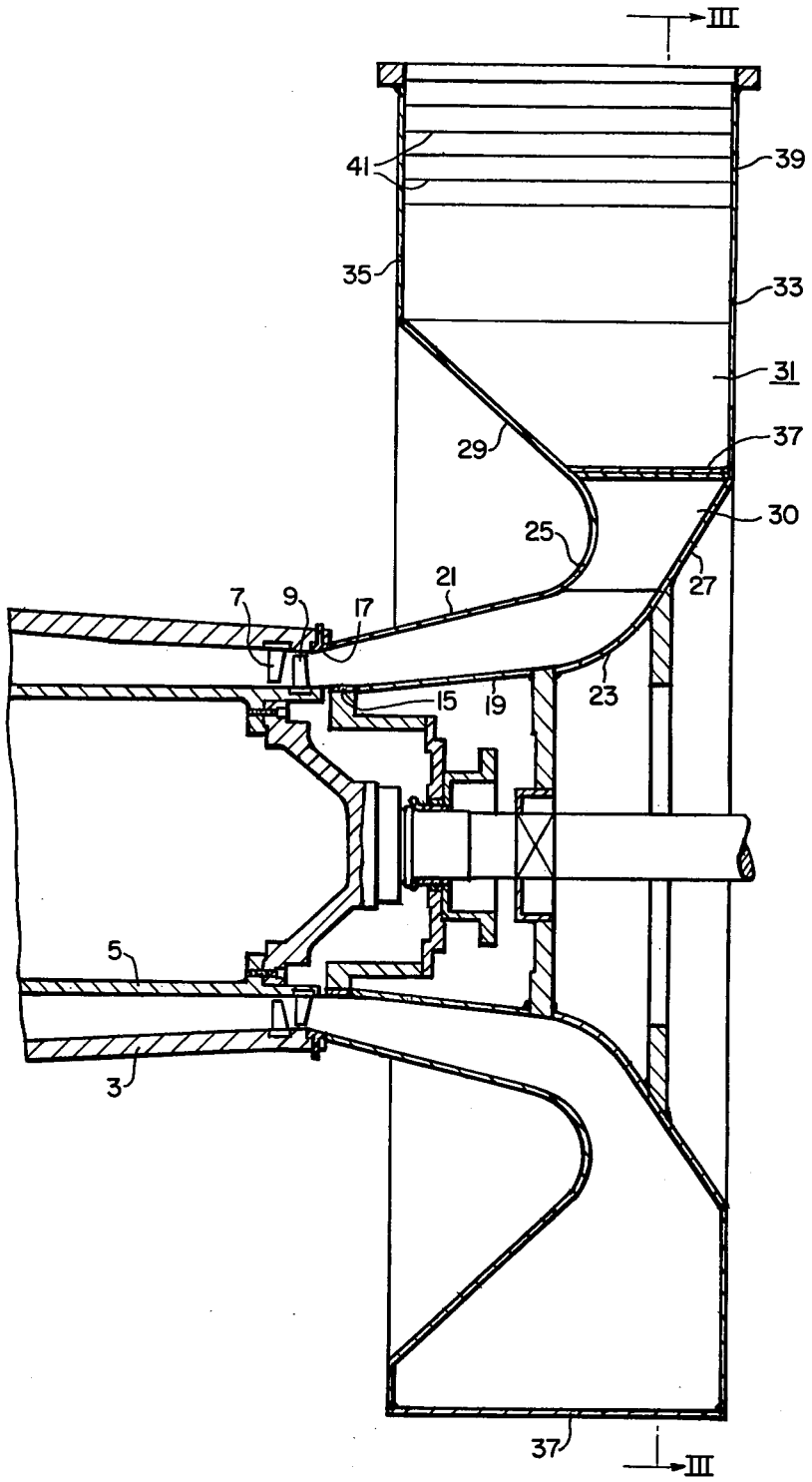
FIG. 2 is an enlarged partial sectional view of the discharge assembly shown in FIG. 1.
Figure 3:
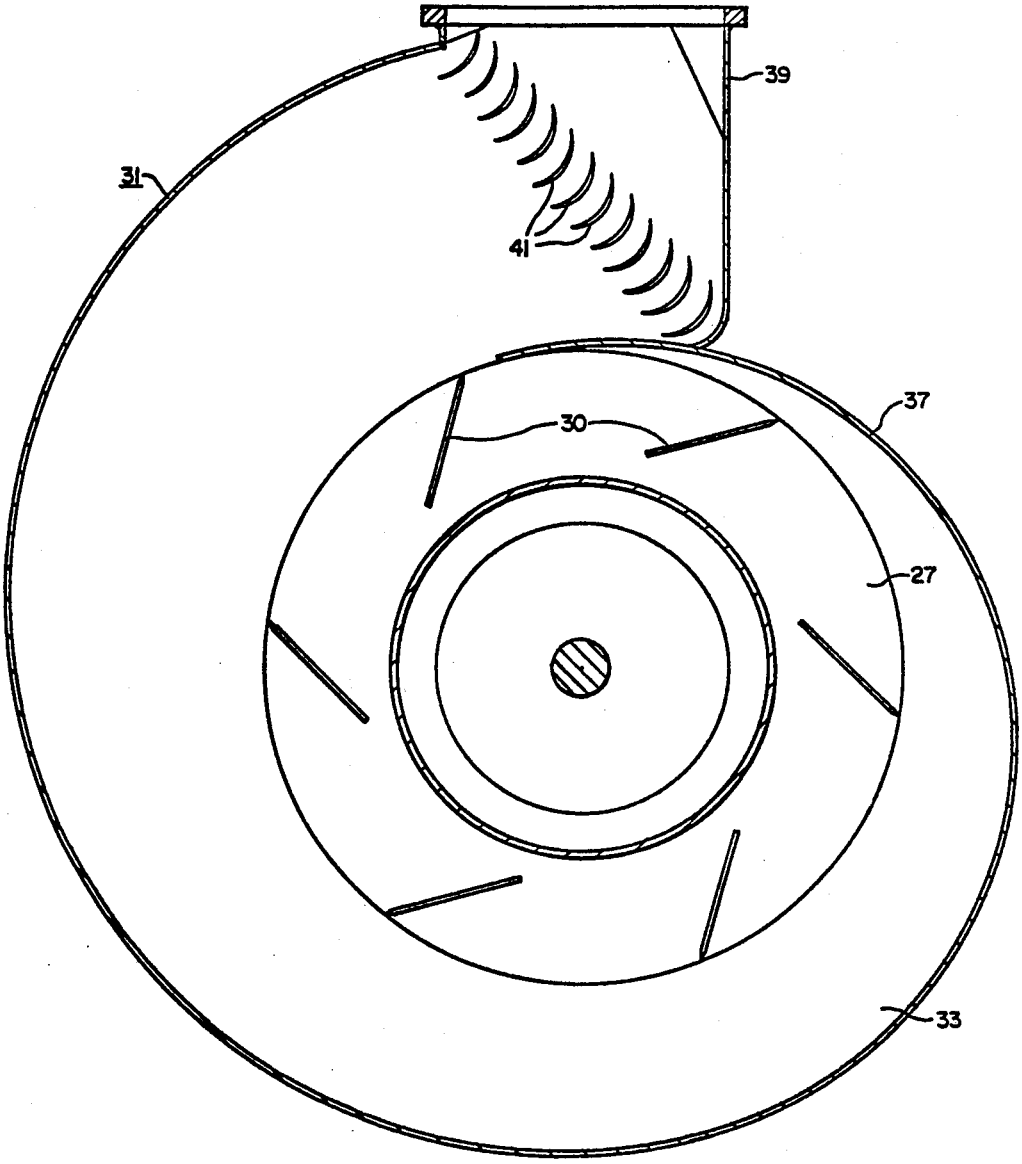
FIG. 3 is a sectional view taken on line III—III of FIG. 2.

Referring now to the drawings in detail and in particular to FIG. 1, there is shown an axial flow compressor 1 for compressing a compressible fluid. The axial flow compressor 1 comprises a housing 3 encircling a rotor 5. Disposed, respectively, on the housing 3 and rotor 5 are multiple circular arrays of stationary blades 7 and rotatable blades 9 are arranged in series to compress the fluid as the rotor is rotated. A fluid inlet assembly 11 is disposed on one end of the compressor, the end on the left as shown in FIG. 1, and a fluid discharge assembly 12 is disposed on the other end of the compressor 1, the end on the right as shown in FIG. 1.

The discharge assembly 12 comprises a diffuser 13 which has an inner and an outer seal ring 15 and 17, respectively, disposed adjacent the last array of rotatable blades 9. An inner and an outer frusto-conical wall portion 19 and 21, respectively, are disposed directly downstream of the last array of rotatable blades 9 and extend radially outwardly and axially outwardly from the inner and outer seal rings 15 and 17, respectively. Inner and outer toroidal wall portions 23 and 25 extend, respectively, from the inner and outer frusto-conical wall portions 19 and 21. A second inner and outer frusto-conical wall portion 27 and 29 are connected, respectively, to the inner and outer toroidal wall portions 23 and 25 outlining diffuser 13. Disposed between the outer toroidal wall portion 25 and the second inner frusto-conical wall portion 27 are a plurality of plates or struts 30 aligned with the flow path to act as stiffeners for the diffuser 13.

A scroll 31 is disposed in fluid communication with the diffuser 13. The scroll 31 comprises a flat plate 33, which extends radially outwardly from the radially outer margin of the second inner frusto-conical wall portion 27, and a second flat radial plate 35 connected to the radially outer margin of the second frusto-conical wall portion 29. The flat radial plates 33 and 35 are generally convoluted and form the back and front sides of the scroll 31. A cover plate 37 spirals outwardly from the margins of the radially outer edge of the second frusto-conical inner wall portion 27 and the radially outer margin of the outer toroidal wall portion 25 increasing at the same rate as the convoluted plates.

A discharge nozzle 39 is disposed to extend radially upwardly from the scroll 31 and has a plurality of turning vanes 41 disposed therein for directing the flow from the spiral path of the scroll. For the application that this invention is to be utilized, it was necessary to have a radially disposed discharge nozzle, however, without this design constraint, it would be more efficient to have the discharge nozzle be an extension of the scroll 31 rather than extending 90° from the end of the scroll 31.

The diffuser 13 and scroll 31 cooperate to form a discharge assembly 12, which efficiently converts the swirling energy in the effluent fluid flowing from the last array of rotatable blades to pressure energy and direct the effluent fluid to the discharge nozzle.

What is claimed is:

1. A discharge assembly for an axial flow compressor having a longitudinal axis and multiple circular arrays of stationary and rotatable blades disposed in series along said axes to compress a compressible fluid, said discharge assembly comprising:

a diffuser disposed directly downstream of the last circular array of rotatable blades, said diffuser having a first inner frustoconical wall portion and a first outer frustoconical portion disposed adjacent said last circular array of rotatable blades, an inner toroidal wall portion and an outer toroidal portion connected, respectively, to the first inner frustoconical wall portion and the first outer frustoconical wall portion, a second inner frustoconical wall portion and a second outer frustoconical wall portion connected, respectively, to the inner toroidal wall portion and the outer toroidal wall portion;

a scroll in fluid communication with said diffuser, and;

a discharge nozzle disposed in fluid communication with said scroll;

said diffuser and scroll cooperating to efficiently convert the swirling energy of the effluen fluid to pressure energy as the effluent fluid flows toward the discharge nozzle.

2. A discharge assembly as set forth in claim 1, wherein the discharge nozzle is disposed to extend radially from the scroll.

3. A discharge assembly as set forth in claim 1 and further comprising a plurality of supports disposed between the inner and outer wall portions of the diffuser and generally aligned with the fluid flow.

* * * * *